United States Patent [19]

Warnaka et al.

[11] Patent Number: 4,562,589

[45] Date of Patent: Dec. 31, 1985

[54] ACTIVE ATTENUATION OF NOISE IN A CLOSED STRUCTURE

[75] Inventors: Glenn E. Warnaka; John M. Zalas, both of Erie, Pa.

[73] Assignee: Lord Corporation, Erie, Pa.

[21] Appl. No.: 449,851

[22] Filed: Dec. 15, 1982

[51] Int. Cl.[4] ..... C10K 11/16

[52] U.S. Cl. ..... 381/71; 381/86

[58] Field of Search ..... 381/71, 95, 56, 94, 381/96, 86

[56] References Cited

U.S. PATENT DOCUMENTS 2,361,071 10/1944 Vang .
3,685,610 8/1972 Bschorr ..... 181/33 L
4,025,724 5/1977 Davidson, Jr. et al. ..... 381/71

FOREIGN PATENT DOCUMENTS

WO81/1480 5/1981 PCT Int'l Appl. .

OTHER PUBLICATIONS

Glenn E. Warnaka, Active Attenuation of Noise-The State of the Art, Noise Control Engineering/May-Jun. 1982, pp. 100-110.

*Primary Examiner*—James L. Dwyer

*Attorney, Agent, or Firm*—Wood, Herron & Evans

[57] ABSTRACT

This invention is directed to a system for the active acoustic attenuation of noise produced in the interior of an enclosure by a source of noise which in one aspect comprises input sensing operable to sense the source noise to be attenuated, cancellor adapted to produce noise 180° out of phase with the source noise and error sensor operable to sense the acoustic summation of the source noise and the noise produced by the cancellor. The input sensor, cancellor and error sensor are each preferably disposed at or immediately adjacent an area of high acoustic pressure within the enclosure. The system further includes a second input sensor disposed adjacent the source of noise, a second cancellor adapted to introduce noise 180° out of phase with the source noise at a location at or immediately adjacent the enclosure wall and second error sensor disposed in the interior of the enclosure. Each set of input sensing means, cancellor and error sensor are adapted to be connected to an electronic controller means operable to process signals from the input sensor, produce outputs to drive the cancellor for the introduction of cancelling sound waves into the enclosure for combination with the source sound waves, and then adjust such outputs based on signals received from the error sensor.

9 Claims, 5 Drawing Figures

ACTIVE ATTENUATION OF NOISE IN A CLOSED STRUCTURE

FIELD OF THE INVENTION

This invention relates generally to the area of active acoustic attenuation, and, more particularly, to an apparatus for the attenuation of noise within a closed body or structure.

BACKGROUND OF THE INVENTION

The attenuation of noise in a closed structure or body created by a source disposed either externally or in the interior of the enclosure, has to this point generally been accomplished by so called passive means of attenuation. As used herein, the term closed structure refers generally to an enclosure having an interior bounded by essentially continuous walls, such as, for example, a room with its doors and windows closed or an airplane fuselage with its exit doors closed. Passive attenuation of sound in such applications has been accomplished by disposing one or more layers of material, such as barrier materials, absorbing materials and damping materials, between the source of the sound and the area where a reduced noise level is desired. For example, assume sound is produced within a closed room or other structure by a source exterior to the enclosure. A typical configuration of passive attenuating materials to achieve a reduced noise level in the enclosure may include an outermost layer of barrier material having a high density disposed adjacent to or at the boundary layer of the enclosure. The high density barrier material reflects at least some of the sound waves propagating from the exterior source of noise outwardly, away from the enclosure. Extending inwardly from the boundary layer in many passive attenuating configurations is a layer of acoustically absorbent material, such as fiberglass, which acts to extract energy from the source sound waves which reflect from the outer barrier material toward the interior of the enclosure. In some applications, the passive means of acoustic attenuation may also include damping materials disposed adjacent the acoustically absorbent material and toward the exterior of the enclosure. Damping materials, such as damping tape and the like, extract further energy from the remaining source sound waves before they enter the interior of the enclosed structure.

Passive means of sound attenuation such as described above provide adequate reductions in noise levels for a variety of applications. However, in other applications, passive attenuating materials are of limited utility. Considering the application of passenger aircraft fuselages, which will be discussed herein to illustrate the advantages of this invention, passive means of noise attenuation create as well as solve problems. As mentioned above, acoustically reflective barrier materials must be relatively dense to be effective in reflecting incident sound waves. The higher the density of a material the more it weighs. It is apparent that the addition of weight to the fuselage of a passenger aircraft to enhance noise attenuation has the adverse affect of reducing fuel economy, payload and flight range. In addition, most acoustically absorbent or damping materials are relatively easily damaged and make poor surfaces for use in the interior of aircraft.

There have been limited efforts in the prior art to achieve reduced sound levels in the interior of enclosed structures in those applications where passive means of attenuation present functional problems. One approach to the attenuation of noise within the interior of an aircraft fuselage, for example, is found in Bschorr U.S. Pat. No. 3,685,610. In this patent, transmitters located externally of the fuselage adjacent the aircraft propeller are operable to produce sound waves having the same frequency and amplitude but of opposed phase to that of the sound produced by the propellers and engines. This is the same general approach taught in Connover U.S. Pat. No. 2,776,020 which involves the attenuation of transformer noise. These designs are directed to the attenuation of sound waves from an exterior source at or near the source before such sound waves can propagate to an area such as a closed structure where a reduced noise level is desired.

A second approach to the attenuation of sound in an aircraft fuselage is found in Vang U.S. Pat. No. 2,361,071 which is directed to a means of reducing aircraft vibration produced by the engines and propellers at a point on or adjacent to the fuselage. In this design, vibration attenuation means are randomly disposed within the interior of the aircraft fuselage. The attenuation means include a displacement type vibration pick-up for sensing the vibration of the fuselage during flight, which pick-ups are adapted to operate electric vibrators mounted to the interior of the fuselage skin for the production of vibration opposed to that acting on the exterior surface of the fuselage. There is no disclosure provided as to the preferred locations of such vibration damping means along the fuselage and it appears that significant difficulty would be encountered in achieving a balance in the vibrations where the units are located throughout the fuselage. In addition, the number of units apparently required would appear to make this approach costly and inefficient.

It is therefore an object of this invention to provide an active means of attenuation of the noise within a closed structure.

It is another object herein to provide an active system for the attenuation of noise within an enclosure such as a closed structure or body produced by a source or sources of noise disposed either exteriorly of or within the enclosure.

It is a further object of this invention to provide an active system for the attenuation of noise within a closed structure produced by a source of noise exterior to the structure, which involves the equalization of the pressure exerted by the source sound waves on the exterior surface of the enclosure.

It is another object of this invention to provide an active attenuator system for the reduction of noise levels within a closed structure in which all elements of the attenuator system are disposed at high acoustic pressure anti-nodes within the structure.

SUMMARY OF THE INVENTION

These and other objects are accomplished in the active acoustic attenuator system of this invention which includes source sound sensing means, cancelling means, error sensing means and electronic controller means. Source sound sensing means are disposed exteriorly of the enclosure adjacent the source of the noise in one aspect of this invention and within the interior of the enclosure in another aspect of the invention, and are operable to produce electrical signals representing the amplitude and phase characteristics of the source sound. Cancelling means are disposed within the interior of the enclosure and are operable to produce cancelling sound which comprises sound waves of corresponding amplitude but opposed phase to that of the source sound. The combination of the source sound with the cancelling sound in the interior of the enclosure is sensed by error sensing means which are operable to produce electrical signals representing the acoustic summation of the amplitude and phase characteristics of the combined source sound and cancelling sound. Electronic controller means are connected with the source sound sensing means, cancelling means and error sensing means of each aspect of this invention and operate to first process the electrical signals received from the respective source sensing means, produce outputs for driving the cancelling means to produce cancelling sound having the appropriate amplitude and phase characteristics, and then to adjust its output based on the electrical signals received from the respective error sensing means.

As discussed in more detail below, it has been found that the positioning of the system elements described above relative to one another and relative to certain areas of the interior of the enclosure is critical to achieving proper attenuation within the enclosure. In one aspect of this invention, source sound sensing means, cancelling means and error sensing means are each preferably disposed at or adjacent an area of high acoustic pressure within the enclosure. Areas of high and low acoustic pressure are formed by propagation of the source sound waves in the enclosure interior, and the locations of these areas can be determined through measurement and/or analysis.

In the second aspect of the active acoustic attenuator herein, input sensing means are disposed adjacent an exterior sound source and cancelling means, which in this aspect of the invention include waveguide means, are placed within the enclosure immediately adjacent an area or areas where sound waves from such exterior sound source are incident against the exterior surface of the enclosure. The pressure exerted against the enclosure's exterior surface by the source sound waves is equalized by cancelling sound waves emanating from the cancelling means in the interior of the enclosure. Vibration of the walls of the enclosure at such localized areas is thus eliminated or at least reduced before the vibration can propagate to the remainder of the enclosure. The error sensing means of this aspect of the invention are disposed in the interior of the enclosure to sense the acoustic summation of the exterior sound waves and the cancelling sound waves.

DETAILED DESCRIPTION OF THE INVENTION

Figure 1:
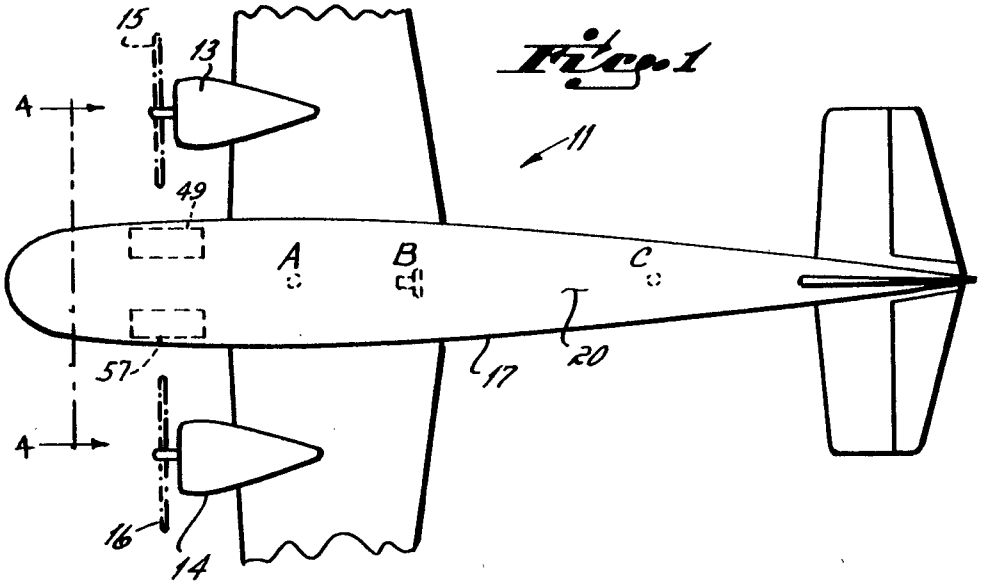
FIG. 1 is a plan view of a propeller driven aircraft including the active acoustic attenuator system of this invention.

Referring now to the drawings and in particular to FIG. 1, the active acoustic attenuator system of this invention is partially shown in association with an aircraft 11 having engines 13 and 14 with propellers 15 and 16, respectively ,and an elongated cylindrical-shaped fuselage 17. It should be understood that while the subject invention is discussed in connection with the attenuation of noise within the interior 20 of an aircraft fuselage 17, this is but one of the applications for which the invention is particularly advantageous. It is contemplated that virtually any essentially closed structures or bodies wherein passive means of sound attenuation are of limited value would benefit from the subject invention.

Generally, noise in the interior of an aircraft is produced by two sources. At lower flight speeds, the most prevalent cause of interior noise is the engines and/or propellers of the aircraft which produce sound waves and vibrations incident against relatively localized areas on the exterior of the fuselage. Vibration of the fuselage is produced at such localized areas which propagates over its entire exterior surface. Noise produced at high cruising speeds includes a significant contribution from boundary layer turbulence or the passage of air over the fuselage and wings of the aircraft at relatively high speeds. Boundary layer turbulence is usually not confined to a particular location on the fuselage but generally occurs over the entire surface area.

Figure 3:
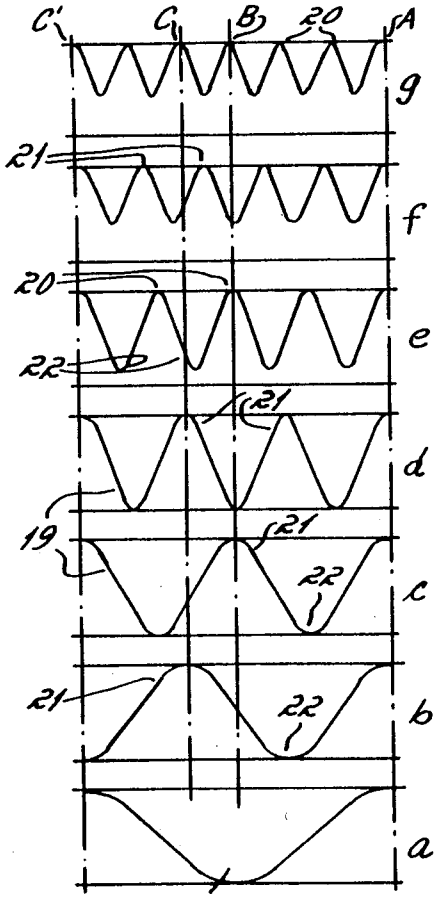
FIG. 3 is a schematic drawing of pressure mode shapes within the airplane fuselage interior.
Figure 2:
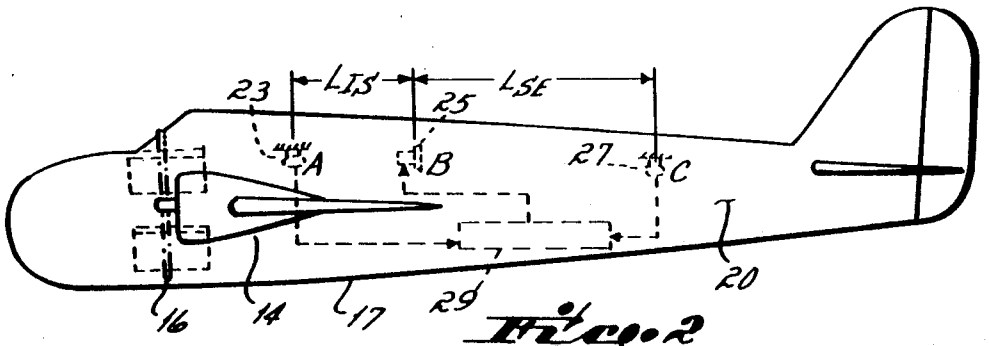
FIG. 2 is a side view of the fuselage of the aircraft shown in FIG. 1, including one aspect of the attenuation system herein.

Referring now to FIG. 2, the first aspect of the active acoustic attenuation system of this invention is illustrated. This portion of the attenuation system is directed primarily to the attenuation of sound occurring everywhere in the fuselage interior 20 which would typically be caused by boundary layer turbulence with at least some contribution from the engines 13, 14 and propellers 15, 16. As is well known, a sound wave consists of a sequence of compressions, or high pressure areas, and rarefactions, or low pressure areas, at a given phase and frequency. In the case of a given aircraft fuselage 17 subjected to typical boundary layer turbulence and engine-propeller noise, stationary sound waves 19 are produced in the fuselage 17 having the amplitude, frequency and phase such as illustrated in FIG. 3.

To reduce the noise level within the fuselage interior 20, secondary or cancelling pressure waves having compressions and rarefactions equal in amplitude but 180° out of phase with the source sound pressure waves 19 are produced by the active acoustic attenuation system herein. The active system includes an input sensor 23 for sensing the noise level within the fuselage interior 20 produced by any original source of sound whether disposed on the exterior or within the fuselage 17. The input sensor 23 may be a microphone, accelerometer or any other suitable type of transducer. A loudspeaker 25, operable to produce cancelling pressure or sound waves, is mounted within fuselage 17 and spaced from input sensor 23. The input sensor 23 is disposed at an upstream location relative to speaker 25 such that the cancelling sound waves produced by speaker 25 propagate in an opposite direction from sensor 23. An error sensor 27 is mounted to fuselage 17 downstream from or in the direction of propagation of the sound from loudspeaker 25. As with input sensor 23, the error sensor 27 is a transducer of some type such as a microphone or accelerometer. The error sensor 27 is operable to sense the acoustic summation of the source sound within the fuselage interior 20 and the cancelling sound produced by loudspeaker 25. Each of these elements is connected to an electronic controller 29 which is shown in more detail in FIG. 5.

As is well known, the principle of so-called active attenuation of sound waves, as opposed to passive attenuation discussed above, is based on the fact that the speed of sound in air is much less than the speed of electrical signals. In the time it takes for a sound wave to propagate from a location where it can be detected to a second location where it may be attenuated, there is sufficient time to sample the propagating wave, process that information within an electronic circuit and produce a signal to drive a speaker for the introduction of cancelling sound 180° out-of-phase and equal in amplitude to the propagating sound.

Figure 5:
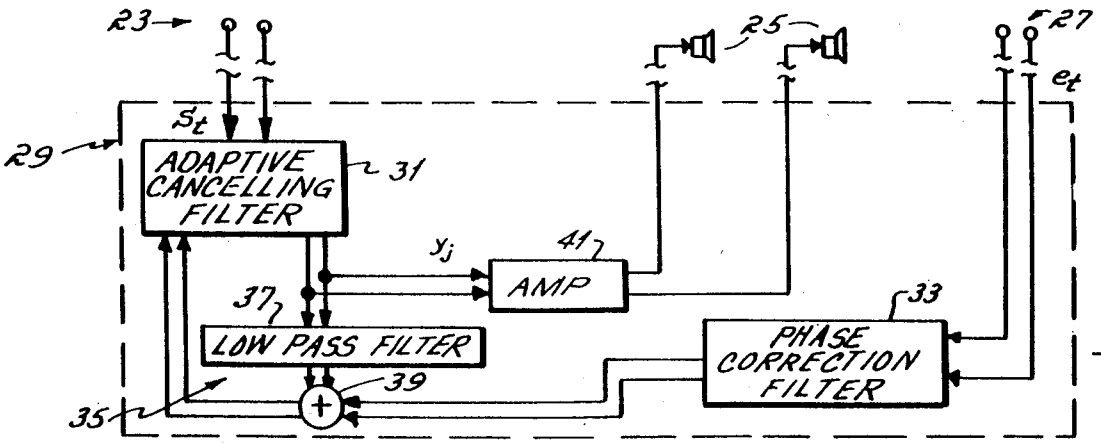
FIG. 5 is a schematic view of the circuitry forming the electronic controller means of the system of this invention.

Referring now to FIGS. 2 and 5, the operation of the active acoustic attenuator system of this invention is illustrated. The source sound within the fuselage 17 is sensed or sampled by the input sensor 23 which produces an electrical signal representing the phase and amplitude characteristics of the source sound. This signal, $S_t$, is sent to the controller 29 as shown in FIG. 2. While only one input sensor 23 is shown in FIG. 2 producing a single output $S_t$, the controller 29 may be provided with a multiplexer or a similar device for processing signals $S_t$ from an array of input sensors 23. Where an array of input sensors 23 is utilized, the controller 29 is operable to serially scan the signals $S_t$ from each input sensor 23 and perform an averaging or summing calculation to produce a single, combined signal $S_t$ for processing in the controller 29. Therefore, as used herein, the signal $S_t$ refers to either the signal from a single input sensor 23 or a combined signal from an array of input sensors 23 comprising the average or summation of such multiple signals.

The controller 29 provides an output $y_j$ to drive loudspeaker 25 which introduces cancelling pressure waves into the fuselage interior 20 having compressions and rarefactions equal in amplitude but 180° out of phase with the source pressure waves 19 (see FIG. 3). The error sensor 27, located downstream from loudspeaker 25, senses or samples the acoustic summation of the source sound and cancelling sound from loudspeaker 25 and produces a signal $e_t$ which is a representation of the amplitude and phase characteristics of such acoustic summation. As with the input sensor 23, a single error sensor 27 is shown in the drawings. However, an array of error sensors 27 may be utilized to sense the summation of the source sound and cancelling sound. The signals $e_t$ produced by such error sensors 27 are combined by the controller 29 in the same manner as discussed above in connection with the input signals $S_t$, to provide an averaged or summed signal $e_t$ which is introduced as an error signal to controller 29.

One example of a controller 29 suitable for use in the adaptive acoustic attenuator of this invention is shown in more detail in FIG. 5. For purposes of discussion and illustration of the operation of the system herein, the controller 29 shown schematically in FIG. 5 is identical to a simplified version of the electronic controller disclosed in U.S. Pat. No. 4,473,906 entitled "Active Acoustic Attenuator", and assigned to the same assignee as the subject invention. Reference should be made to that disclosure for a detailed discussion of an electronic controller, and that patent is expressly incorporated by reference herein.

Controller 29 includes an adaptive cancelling filter 31 which receives electrical signals $S_t$ directly from the input sensor 23. The electrical signals $e_t$ from the error sensor 27 are sent to a phase correction filter 33 which compensates for any acoustic resonances which may occur within fuselage 17. The filtered error signal is then sent to a DC loop, labelled generally with the reference numeral 35, which includes a low pass filter 37 and a summer 39. The DC loop 35 is necessary to assure stable operation of the adaptive cancelling filter 31 as discussed in the above-identified U.S. patent application Ser. No. 213,254.

The adaptive cancelling filter 31 is operable to receive input signals from the input sensor 23, which, in effect, are samples of the waveforms comprising the source sound within fuselage 17. Since sound waves are not single impulses but continuous waveforms, a sampling technique must be used wherein the input signals are discreet samples of the waveform taken at regular time intervals. The filter 31 delays, filters and scales these input signals, and then produces an output $y_j$ which is amplified in amplifier 41 and then sent to the cancelling speaker 25 for the introduction of cancelling sound into fuselage 17. The error sensor 27 senses the summation of the combined cancelling sound and source sound, and produces an electrical signal which is processed in controller 29. As discussed in detail in the U.S. Pat. No. 4,473,906, the error signals from error sensor 27 are processed in the adaptive cancelling filter 31 with the input signals which created the error signals so that the outputs $y_j$ sent to the cancelling speaker 25 may more nearly approximate the mirror image of the actual amplitude and phase characteristics of the source sound.

In order to perform the calculations required to delay, filter and scale the input signals $S_t$ to produce an output, and then adjust the output $y_j$ based on the error signals $e_t$, some delay is associated with the operation of the controller 29. This delay is expressed herein as follows:

$$T_c = T_F + T_R \tag{1}$$

Where:

$T_c$ = total controller delay $T_F$ = delay associated with the adaptive cancelling filter $T_R$ = delay associated with the remainder of the controller circuitry Considering the total delay $T_c$ associated with controller 29, the spacing between input sensor 23 and speaker 25, $L_{IS}$, and the spacing between speaker 25 and error sensor 27, $L_{SE}$, must be adjusted within ranges to achieve proper attenuation of the source sound in fuselage 17.

The distance $L_{IS}$ between input sensor 23 and speaker 25 must be sufficient so that the time required for the sampled source sound to travel therebetween is greater than the total controller delay time. Expressed in equation form the relationship is as follows:

$$T_{IS} \geqq T_c \tag{2}$$

Where:

$T_{IS}$ = time required for the source sound to travel between the input sensor 23 and speaker 25

Equation (2) means that in the time required for the source sound to travel from the input sensor 23 where it is sampled, to the speaker 25 where cancelling sound is combined with the source sound, the controller 29 must be allowed the time to produce an output $y_j$ for driving speaker 25. For example, assuming the total delay or process time of the controller 29, $T_c$, is equal to 0.004 seconds and given the speed of sound in air is 1130 ft./sec., the distance $L_{IS}$ between the input sensor 23 and speaker 25 must be greater than or equal to about 4.5 feet. This spacing assures that the time $T_{IS}$ will be greater than or equal to about 0.004 seconds.

Similarly, the distance $L_{SE}$ between the cancelling speaker 25 and the error sensor 27 must be sufficient to provide the adaptive cancelling filter 31 of controller 29 with sufficient time to produce an output $y_j$, send it to the speaker 25 and have the speaker 25 introduce cancelling sound into the fuselage 17. Expressed in equation form:

$$T_{SE} \geqq T_F \quad (3)$$

Where:

$T_{SE}$ = time required for combined source sound and cancelling sound to propagate from the speaker 25 to error sensor 27

As mentioned above, the source sound is first sampled by input sensor 23, propagates to cancelling speaker 25 for combination with the cancelling sound, and then propagates to the error sensor 27 for sampling. A finite length of time is required for the source sound to reach the error sensor 27 from the input sensor 23 and speaker 25. The controller 29 is adapted to store the input samples of the source sound received from the input sensor 23 for later processing with the error signals caused by such source sound, which are sampled at a later time by error sensor 27. This storage and processing time has been identified above as the adaptive cancelling filter processing time $T_F$. Equation 3 indicates that this delay time $T_F$ must be accommodated by positioning the cancelling speaker 25 and error sensor 27 apart a distance $L_{SE}$ so that sound propagating therebetween arrives at the error microphone 27 from speaker 25 before or at the same time ($T_{SE}$) that the adaptive cancelling filter 31 completes its processing function.

The distances $L_{IS}$ and $L_{SE}$ discussed above must be chosen to satisfy Equations (2) and (3) for assuring optimum attenuation of the source sound within fuselage 17. The requirements of Equations (2) and (3) are a function of the delays inherent in the operation of controller 29, and similar delays would be encountered in the use of any other adaptive system. It has been found that a second requirement must be satisfied in the spacing between input sensor 23 and speaker 25, $L_{IS}$, and between speaker 25 and error sensor 27, $L_{SE}$, which spacing is independent of the type of electronic controller used in this invention.

Referring now to FIGS. 1–3, assume that a source of sound is provided which produces stationary pressure waves 19 within the fuselage interior 20 having areas of high acoustic pressure 21 and low acoustic pressure 22. It is contemplated that for any given enclosure and sound source, such areas 21, 22 could be measured and/or analytically determined. It has been found, that optimum attenuation is achieved within an enclosure such as the fuselage 17 by placing the input sensor 23, error sensor 27, and, to the extent possible, the speaker 25, at or immediately adjacent an area of high acoustic pressure 21. Markedly lesser attenuation is achieved if particularly the input and error sensors 23, 27 are disposed at or near a low acoustic pressure area 22.

In FIGS. 1–3, a single input sensor 23, speaker 25 and error sensor 27 are disposed at locations A, B and C, respectively, within the fuselage interior 20. Provided the assumed source sound input and fuselage interior 20 configuration remain constant, a single input sensor 23 disposed at location A will always sense the source sound at or immediately adjacent a high acoustic pressure area 21. This is not true for the error sensor 27 disposed at location C. Therefore, in some applications, it may be necessary to dispose an array of error sensors 27 or input sensors 23 within a given enclosure so that at least one sensor is positioned at or immediately adjacent an area of high acoustic pressure for all anticipated sound pressure patterns. For example, in the application shown in FIGS. 1–3, a second error sensor 27 could be positioned at location C′ to assure that at least one error sensor 27 is disposed at or immediately adjacent a high acoustic pressure area 21 for each of the pressure patterns in FIGS. 3*a–g*. As discussed above, the controller 29 is adapted to serially scan the signals $S_t$ from more than one input sensor 23 and/or signals $e_t$ produced by multiple error sensors 27, and calculate an average or summation of such signals for processing. Therefore, several input sensors 23 and error sensors 27 may be utilized in any enclosure depending on the pattern of the sound waves developed therein from a given sound source. Although the speaker 25 is preferably disposed at or adjacent a high acoustic pressure area 21, it has been found that attenuation provided by the system 11 is not significantly affected where speaker 25 is spaced from a high acoustic pressure area 21 to some degree.

Therefore, the first aspect of this invention shown in FIGS. 2 and 3 involves the preferred positioning of the input sensor 23, speaker 25 and error sensor 27 relative to one another ($L_{IS}$, $L_{SE}$) to satisfy equations (2) and (3), and relative to the areas of high acoustic pressure established by the source sound within a given enclosure such as fuselage 17. The distances $L_{IS}$ and $L_{SE}$ must be chosen to accommodate both the delays associated with the controller 29 and the pressure pattern established in the enclosure by any given source sound.

Figure 4:
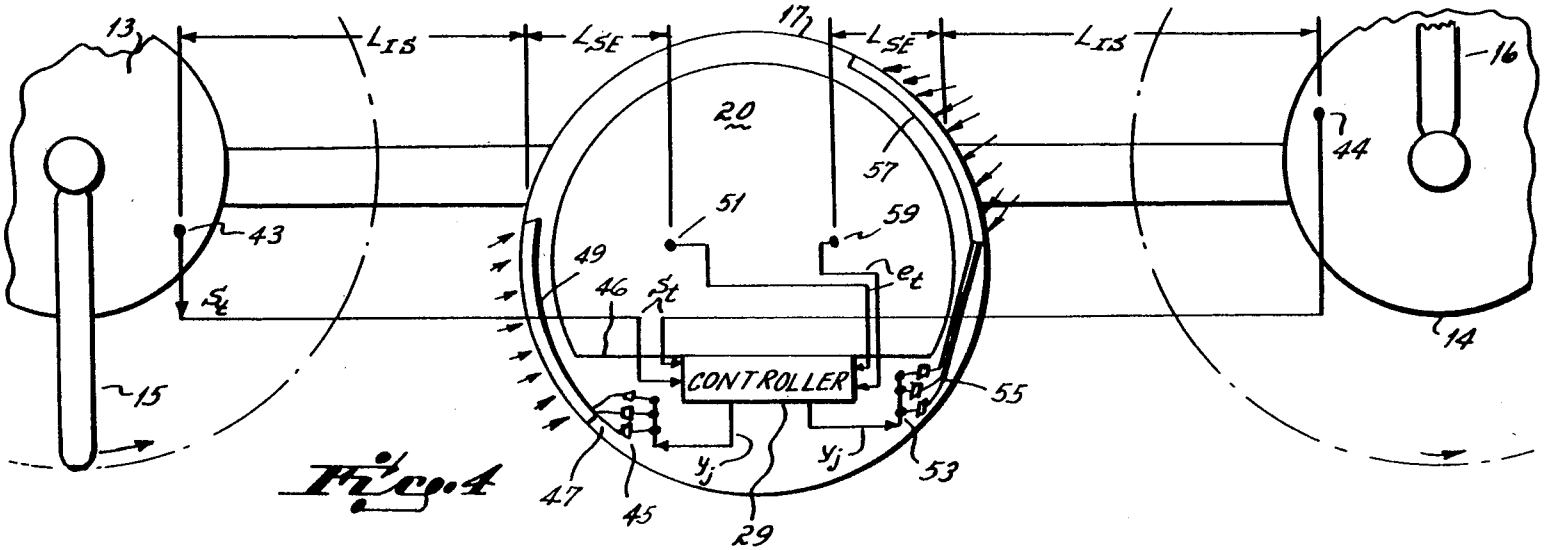
FIG. 4 is a partial cross-sectional view taken generally along lines 4—4 of FIG. 1 showing a second aspect of the active acoustic attenuator system of this invention.

Referring now to FIG. 4, the second aspect of the active acoustic attenuator of this invention is shown. As mentioned above, a major source of noise within the aircraft fuselage interior 20 during lower air speeds or while the aircraft is idling results from vibration of the fuselage 17 caused by the aircraft engines 13, 14 and propellers 15, 16. As shown in FIG. 4, pressure waves produced by the rotation of propellers 15, 16 strike the exterior surface of fuselage 17 in a pattern over a relatively well defined area. These pressure waves cause the fuselage 17 to vibrate in such areas, which vibration propagates over the entire surface area of the fuselage 17 thus creating noise within the fuselage interior 20. The aspect of the active acoustic attenuator herein shown in FIG. 4 is directed toward creating pressure waves on the interior surface of the fuselage 17 over the same area or areas as the pressure waves incident on the exterior surface, which interior pressure waves are of the same intensity and amplitude but 180° out-of-phase with the exterior pressure waves.

This is accomplished by the configuration of FIG. 4 wherein input sensor 43 and 44 are mounted to each of the engines 13, 14 of aircraft 11, respectively. Input sensors 43, 44 are accelerometers or similar vibration sensitive transducers operable to produce an electric signal which represents the amplitude and phase characteristics of the vibration produced by engines 13. One or more loudspeakers 45 are mounted within the fuselage 17 beneath the floor 46 or in some other convenient location. Speakers 45 are connected to the controller 29 as discussed in detail above. The speakers 45 connect through channels 47 to a wave guide 49 mounted immediately adjacent fuselage 17 within at least one wavelength of the highest frequency of source sound to be attenuated. The waveguide 49 is shaped in a configuration corresponding to the pattern in which the sound waves produced by engine 13 and propellers 15 impinge against the exterior surface of the fuselage 17.

In the manner described above, controller 29 is operable to produce an output for driving speakers 45 so that cancelling sound pressure waves are introduced into waveguide 49 which, when they emerge from the wave guide, are equal in intensity and amplitude but opposite in phase to the source sound waves incident on the exterior surface of fuselage 17. Since the waveguide 49 extends over an area of the interior of the fuselage 17 which corresponds in shape to the pattern of the exterior sound waves on the exterior surface of fuselage 17, the pressure exerted against the fuselage 17 by the exterior sound waves at such location is at least partially equalized by the interior sound waves before vibrations produced at the interface can propagate to the remaining surface area of fuselage 17. An error sensor 51 is mounted in fuselage 17 in the vicinity of waveguide 49 which is operable to produce an electrical signal representing the amplitude and phase of the combined exterior and interior sound waves produced at the localized area of the waveguide 49.

Similarly, a second array of speakers 53 is disposed on the opposite side of fuselage 17 to accommodate the pressure waves produced by the other engine 14 and propellers 16. The speakers 53 are connected to controller 29 through amplifiers and each are operable to propagate cancelling pressure waves through channels 55 and into a waveguide 57. Waveguide 57 is mounted to the interior of fuselage 17 at a location where the exterior pressure waves from engine 14 and propellers 16 impinge against the fuselage 17, and is shaped as nearly as possible to the pattern in which such exterior pressure waves strike the fuselage 17. The net pressure at such location of the fuselage 17 is thus at least partially equalized before vibration induced by the exterior sound waves can propagate throughout fuselage 17. An error microphone 59 is disposed within the interior 20 and is operable to produce an electrical signal representing the amplitude and phase characteristics of the combined interior sound waves and exterior sound waves produced in the vicinity of waveguide 57.

The operation of controller 29 in this aspect of the invention is identical to that described above. The controller 29 is operable to process input signals from sensors 43, 44, produce outputs $y_j$ to the speaker arrays 45, 53 and process error signals from the error microphones 51, 59 in the manner discussed above. In addition, it is contemplated that more than one input sensor 43, 44, and error sensor 51, 59 could be utilized for both sides of the fuselage 17 in the aspect of this invention shown in FIG. 2, with the signals produced by such elements being processed by controller 29 in the manner discussed above.

As mentioned above, the distance $L_{IS}$ between the input sensor and cancelling speakers, and the distance $L_{SE}$ between the cancelling speakers and error sensors must be held within ranges to accommodate the acoustic delays associated with the controller 29 and satisfy Equations (2) and (3). This general rule is true for the aspect of this invention shown in FIG. 4, with slight modification. Equation (2) provides that the distance $L_{IS}$ between the input sensors and cancelling speaker must be such that the time required for the source sound to propagate between those system elements, $T_{IS}$, is greater than or equal to the total delay associated with controller 29, $T_c$. In the first aspect of this invention, the cancelling speaker 25 is disposed within fuselage 17 and the cancelling sound it produces enters fuselage 17 immediately. The aspect of this invention shown in FIG. 4 includes waveguides 49, 57 through which the cancelling sound propagating from speaker arrays 45, 53 travels before being combined with sound waves acting on the exterior surface of fuselage 17. Therefore, an additional system delay $T_w$ is added to the total controller delay $T_c$ with the addition of waveguides. This additional delay requires modification of original equation (2) as follows:

$$T_{IS} \geqq T_c + T_w \tag{4}$$

Where:

$T_w$=time required for cancelling sound from the cancelling speakers to propagate to a point for combination with the source sound.

Therefore, the distance $L_{IS}$ between the input sensors 43, 44 and waveguides 49, 57, respectively, on each side of the fuselage 17 must be adjusted to accommodate the additional system delay added by the time of propagation of the cancelling sound within waveguides 49,57.

Although described separately, it is contemplated that the two aspects of this invention shown in FIGS. 2 and 4 may be combined as illustrated in FIG. 1 to provide an active acoustic attenuator system for any enclosure subjected to a variety of different noise inputs such as is the case with an aircraft fuselage 17. Additionally, each aspect may be used separately in a particular application where circumstances warrant. For example, attenuation of source sound in a truck cab where the noise input is concentrated in a relatively defined area at the mounting points of the cab to the frame may be one application where the FIG. 4 approach would be preferred. Other applications for either one or both of the aspects of the invention herein are also possible.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A system for the attenuation of sound waves produced in a closed structure having walls, an exterior surface and an interior by a source of sound waves exterior to said closed structure, comprising:

input sensing means disposed adjacent said exterior source of sound waves, said sensing means being operable to produce electrical signals representing the amplitude and phase characteristics of said exterior sound waves, said exterior sound waves impinging against said exterior surface of said closed structure in a pattern and inducing vibration of said walls to produce sound waves in the interior of said body;

cancelling means for generating cancelling sound waves of corresponding amplitude and 180° out-of-phase with said exterior sound waves;

waveguide means disposed in the interior of said closed structure immediately adjacent said wall of said closed structure in the area of impingement of said exterior sound waves, and being spaced from said sensing means, said waveguide means being connected to said cancelling means to provide a path for the propagation of said cancelling sound waves to said closed structure wall for combination with said exterior sound waves;

error sensing means disposed within said interior of said closed structure and being spaced from said waveguide means, said error sensing means being operable to produce electrical signals representing the amplitude and phase characteristics of said combination of said exterior sound waves and cancelling sound waves at said closed structure wall; and electronic controller means connected with said input sensing means, cancelling means and error sensing means, said electronic controller means being operable to process said electrical signals from said input sensing means, produce outputs for driving said cancelling means to produce said cancelling sound waves, and to adjust said outputs based on said electrical signals from said error sensing means for the production of revised outputs for driving said cancelling means.

2. The system of claim 1 wherein said waveguide means is formed with a section disposed from said enclosure wall a distance of approximately one wavelength of the highest frequency of said exterior sound waves to be attenuated.

3. The system of claim 1 wherein said waveguide means includes a section mounted immediately adjacent said enclosure wall, which section is formed in a shape approximating said pattern in which said exterior sound waves impinge against said exterior surface of said closed structure wall.

4. The system of claim 1 wherein separate sensing means, cancelling means, waveguide means and error sensing means are provided for each location of impingement of said exterior sound waves against said exterior surface of said closed structure.

5. A system for the attenuation of sound waves produced in a closed structure having walls, an interior and an exterior surface by at least one source of sound, said source sound waves producing a plurality of areas of high acoustic pressure and low pressure within said interior of said closed structure, and at least a portion of said source sound waves impinging against said exterior surface of said closed structure in a pattern and inducing vibration of said walls, said system comprising:

first input sensing means disposed adjacent to an area of high acoustic pressure within said interior, and second input sensing means disposed adjacent said source of sound, said first and second input sensing means being operable to sense said source sound waves and produce electrical signals representing the amplitude and phase characteristics of said source sound sensed thereby;

first cancelling means disposed within said closed structure and being spaced from said first input sensing means, and second cancelling means disposed adjacent said closed structure wall and being spaced from said second input sensing means, said first and second cancelling means being operable to generate cancelling sound waves of corresponding amplitude but 180° out-of-phase with said source sound waves for combination therewith;

first error sensing means disposed adjacent to a high acoustic pressure area within said closed structure and being spaced from said first cancelling means, and second error sensing means disposed within said closed structure and being spaced from said second cancelling means, said first and second error sensing means being operable to sense the acoustic summation of said source sound waves and cancelling sound waves and produce electrical signals representing the amplitude and phase characteristics of said combination of said source sound waves and cancelling sound waves; and first electronic controller means connected with said first input sensing means, said first cancelling means and said first error sensing means, said first electronic controller means being operable to process said electrical signals from said first input sensing means, produce outputs for driving said first cancelling means to produce said cancelling sound waves, and to adjust said outputs based on said electrical signals from said first error sensing means for the production of revised outputs for driving said cancelling means; and second electronic controller means connected with said second input means, said second cancelling means and said second error sensing means, said second electronic controller means being operable to process said electrical signals from said second input sensing means, produce outputs for driving said second cancelling means to produce said cancelling sound waves, and to adjust said outputs based on said electrical signals from said second error sensing means for the production of revised outputs for driving said cancelling means.

6. The system of claim 5 wherein said second cancelling means includes at least one loudspeaker connected to a waveguide means, said waveguide means being disposed adjacent said closed structure wall.

7. The system of claim 6 wherein said waveguide means is formed with a section disposed from said enclosure wall a distance of approximately one wavelength of the highest frequency of said exterior sound waves to be attenuated.

8. The system of claim 6 wherein said waveguide means includes a section mounted immediately adjacent said enclosure wall, which section is formed in a shape approximating said pattern in which said exterior sound waves impinge against said exterior surface of said closed structure wall.

9. The system of claim 5 wherein separate sensing means, cancelling means, waveguide means and error sensing means are provided for each location of impingement of said exterior sound waves against said exterior surface of said closed structure.

* * * * *